US005255042A

United States Patent [19]

Fischer et al.

[11] Patent Number: 5,255,042

[45] Date of Patent: Oct. 19, 1993

[54] TOP-DROP FILM FEED SYSTEM

[75] Inventors: Warren G. Fischer; Leonard P. Krystal, both of Kane County, Ill.; Thomas P. Muchisky, St. Louis, Mo.

[73] Assignee: Fischer Industries, Inc., Geneva, Ill.

[21] Appl. No.: 771,203

[22] Filed: Oct. 4, 1991

[51] Int. Cl.[5] ..... G03D 3/08; G03D 13/02

[52] U.S. Cl. ..... 354/319; 354/338

[58] Field of Search ..... 354/318-321, 354/323, 324, 336-339

[56] References Cited

U.S. PATENT DOCUMENTS

| | | | |
|---|---|---|---|
| 3,694,071 | 9/1972 | Touchette | 354/339 |
| 4,099,194 | 7/1978 | Kümmerl | 354/321 |
| 4,324,479 | 4/1982 | Sachs | 354/319 |
| 4,505,565 | 3/1985 | Tanaka | 354/320 X |
| 4,515,456 | 5/1985 | Ferrante | 354/320 |
| 4,941,008 | 7/1990 | Nakamura | 354/320 |

*Primary Examiner*—D. Rutledge

*Attorney, Agent, or Firm*—Polster, Polster and Lucchesi

[57] ABSTRACT

A film processor is provided with a top-drop film system which, in the perferred embodiment includes a slot in the top housing cover of the processor, an inclined-plane film guide directly beneath the slot, and a pair of opposing rollers positioned at the bottom edge of the film guide. The top-drop slot allows films to be dropped into the processor, rather than hand-positioning and hand-feeding each film. The specific roller locations and film guide angle allows films to be fed into the processor automatically and consistantly without "snapping" or over-bending, and without need for operator presence or attention. The inclined-plane film guide is designed for easy removal for cleaning. The guide is mounted in precise-angle slots to maintain angle consistency. The extra width of the top-drop slot allows panoramic films to be processed in a sideways configuration, thereby increasing processing speed by 30% over comparable prior art devices.

7 Claims, 2 Drawing Sheets

TOP-DROP FILM FEED SYSTEM

BACKGROUND OF THE INVENTION

This invention relates, generally, to film processing apparatus, and more particularly, to an improved system for feeding films into such devices. While the invention is designed with particular emphasis on automatic processing appartus, those skilled in the art will recognize the wider applicability of the inventive principles described hereinafter.

As is known in the art, in the typical film processing apparatus, film is fed into such devices in a horizontal position, often on a horizontal feed tray. The film is hand-fed along the travel axis of the film in such devices. Each individual film is hand fed with film edges parallel with the axis of the rollers until said film is grasped by opposing sets of rollers or by opposing sets of web-mesh carrier belts. The films are thereafter conveyed through the film processor apparatus by such rollers or belts, sequentially through a developer solution, a fixer solution, a water bath and a drying section, and thereafter, exit from said film processing apparatus.

In typical film processing apparatus, the speed at which film is transported through such devices is quite slow, thereby requiring the operator to remain at the film feed station for several seconds, for each film being fed, in order to insure that the rollers or belts have indeed grasped each film and begun transport of same. Nonetheless, films are on occasion not fully grasped by said rollers or belts, and remain on feed trays after being released by the operator. In such cases, the non-inserted films are often exposed to light, thereby rendering them worthless. If not worthless, the film remains on the feed trays until later discovered, causing delays in service.

The invention disclosed hereinafter overcomes these prior art difficulties by providing a drop-in feed mechanism for the processor which can accomodate a variety of film sizes, and orientations without requiring further assistance from the operator. The feed system disclosed hereinafter is incorporated in a novel processor, portions are of which are described in U.S. Ser. No. 635281, filed Dec. 28, 1990, U.S. Ser. No. 641459, filed Jan. 14, 1991, U.S. Ser. No. 771,737, filed Oct. 4, 1991 entitled Improved Solution Filling System For A Film Processor Apparatus, U.S. Ser. No. 771,205, filed Oct. 4, 1991, entitled Improved Switching System For Film Processor. The disclosures of each of these related applications are extended to be incorporated herein by reference.

One of the objects of this invention is to provide an improved film entry system for a film processor.

Another object of this invention is to provide a low cost film entry mechanism for a film processor.

Another object of this invention is to provide a film entry device for a film processor having low maintenance requirements.

Another object of this invention is to provide a film entry device for a film processor which is capable of receiving differing film sizes at different orientations, so that an operator need not orient the film to be processed along any particular predefined direction or axis.

Other objects of this invention will be apparent to those skilled in the art in light of the following description accompaning drawings.

SUMMARY OF THE INVENTION

In accordance with this invention, generally stated, a film feeding system includes a top-drop slot, an inclined-plane film guide rack, and of a specifically-positioned catch-and-feed rollers. A slot is formed in the top housing cover of a film processing apparatus, sufficient in width to accept all required-size films, and sufficient in depth to make it easy to drop films into, without necessity for precise positioning. Films dropped into the top-drop slot fall directly downward, by gravity, onto an inclined-plane film feed guide, and slide down said guide. The films on said guide slide down onto a catch roller, contacting said catch roller at a precise position such that the catch roller lifts the edge of each film automatically up and into contact with a top feed roller, and this dual contact, between the bottom catch roller and the top feed roller, automatically grasps each film and initiates transport of said films into and through the film processing apparatus. Films may be dropped into the top-drop slot, side-by-side, as fast as an operator can release them, and all films automatically enter the transport system without any need for operator attention or an operator's continued presence.

DETAILED DESCRIPTION OF THE INVENTION

Figure 1:
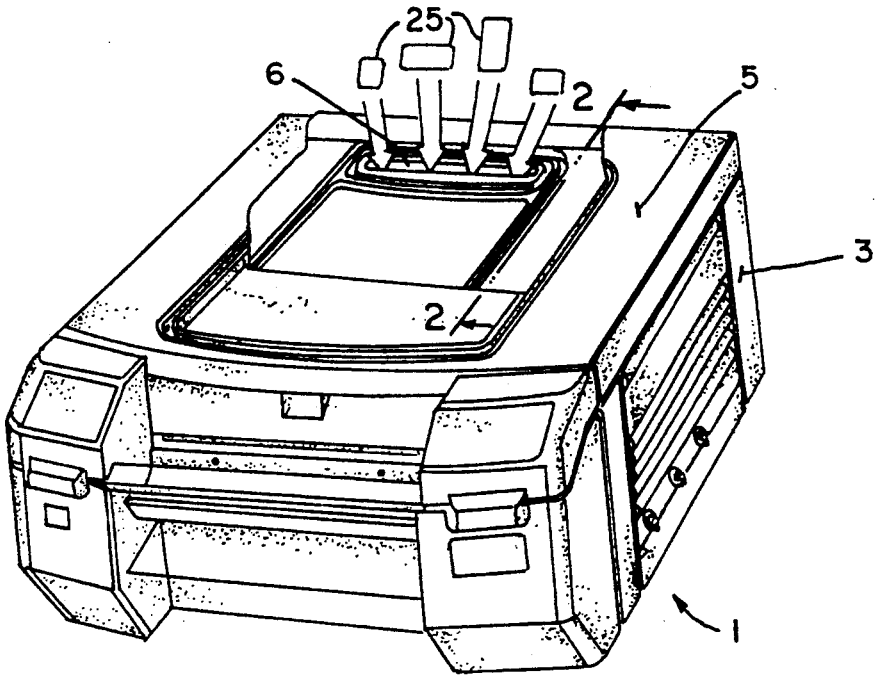
FIG. 1 is a perspective view of one illustrative embodiment of the film processor apparatus using the feed system of the present invention.

Referring more particularly to FIG. 1, the film processor of the invention is shown generally at 1. The film processor 1 consists of a lower housing 3 defining a chamber C containing a film developing system. The film developing system includes the solution tanks, transport system, pumps, motor and controls as is known in the general art. This invention is related to the inventions disclosed in copending applications U.S. Ser. No. 07/635281 filed Dec. 28, 1990, entitled Heat Exchanger, U.S. Ser. No., 07/641459 filed Jan. 14, 1991, entitled Roller Tank, U.S. Ser. No. 771,737, entitled Improved Solution Filling System For A Film Developer Apparatus, filed Oct. 4, 1991, and U.S. Ser. No. 771,205, entitled Improved Switching System For A Film Processor Apparatus, filed Oct. 4, 1991. All of these applications are assigned to the assignee of the present application. The disclosure of these copending and commonly assigned applications are intended to be incorporated by reference herein. A removable upper housing top 5 covers the lower housing 3 to isolate the internal workings of the film processor apparatus from the surrounding environment.

Figure 2:
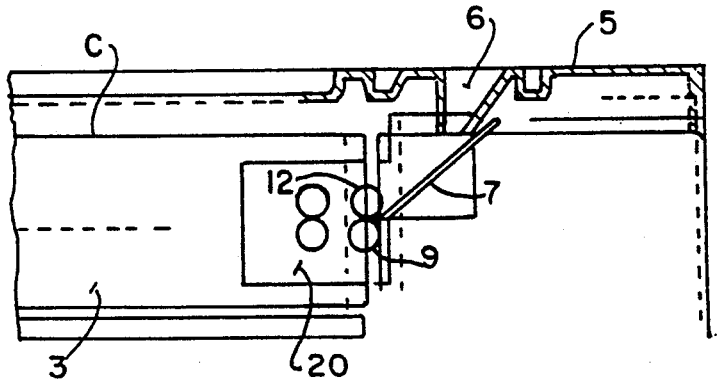
FIG. 2 is a partial sectional view, partly broken away and taken along the lines 2—2 of FIG. 1.
Figure 3:
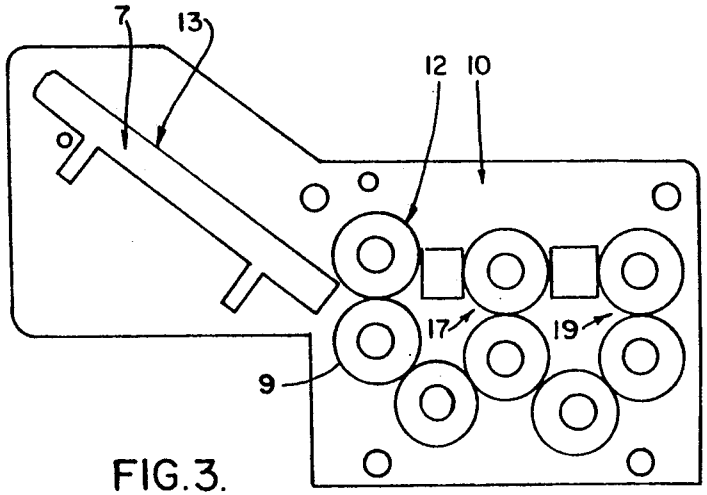
FIG. 3 is a side view of the inclined-plane film feed guide and the catch-roller, top feed roller and transport rollers.
Figure 4A:
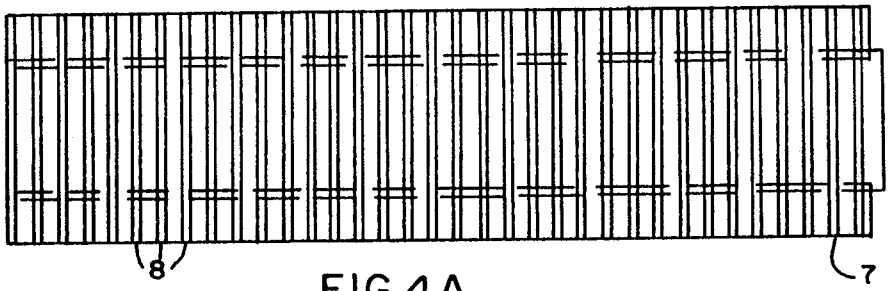
FIG. 4*a*–4*c* are top, side and end views respective of the film guide used to form the inclined-plane for the system of this invention.
Figure 4B:
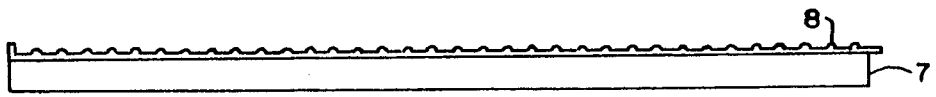
Figure 4C:
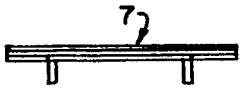

Referring to FIG. 2, the upper housing top 5 incorporates a top-drop slot 6 into which films may be vertically dropped. Films dropped through said slot land on an inclined-plane film guide rack 7, particularly as shown in FIGS. 3 and 4. Both the top-drop slot 6 and the inclined-plane film guide are fixed in relationship of one to the other by end panel structures incorporated in a removable developer transport rack 7 in the lower housing 3. Accordingly, all film dropped through the top-drop slot 6 must land on the inclined-plane film guide rack 7, positioned directly below the top-drop slot 6. The inclined-plane film guide rack 7 has polished ribs 8 on its upper surface, to minimize friction. The ribs 8 are spaced such that the smallest film the processor is intended to process will lay on a minimum of two ribs. All film inserted in the slot 6 drop freely through the top-drop slot 6, land on the polished ribs 8 of the inclined-plane film guide rack 7, and slide, by gravity, down the film guide rack 7, to catch-roller 9, as shown in FIG. 2, which, like its rack 7, is mounted in developer transport rack 20.

Figure 5:
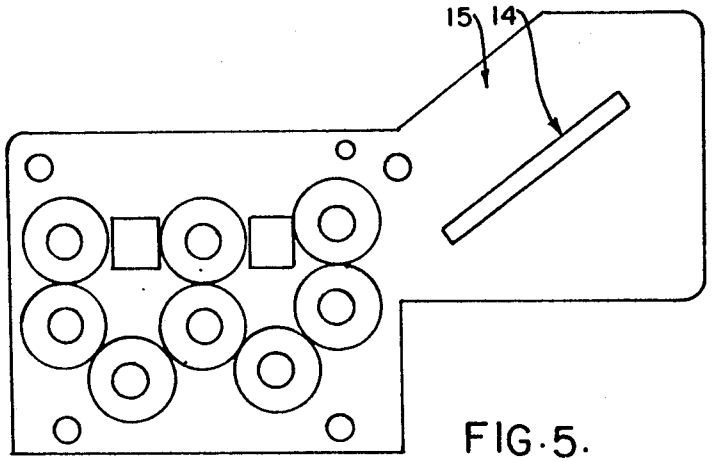
FIG. 5 is a side view, opposite to that shown in FIG. 3 of the film guide used in conjunction with the system of this invention.

In order to facilitate cleaning, the inclined-plane film guide rack 7 is designed to slide into and out of slots 13 and 14 in the developer transport rack 20 sideplates 10 and 15 respectively, best shown in FIGS. 3 and 5.

The width of the top-drop slot, the angles of the planes which form the interior surfaces of the top-drop slot and the angle at which the inclined-plane film guide rack 7 is positioned are all determined by the sizes and types of film 25 to be processed. In the preferred configuration shown for dental applications, the widths and angles illustrated allow for the acceptance of all known dental films, from periapical to cephalographic. The established angles provide for minimal bending of films, and for smooth film transition from the verticle plane to the horizontal plane, since severe or repeated bending or rapid bending or "snapping" of film can cause flaking-off of emulsion coatings and corresponding loss of film image.

As deposited films slide down to the catch-roller 9, the counter clockwise motion of catch-roller 9, referenced to FIG. 2, lifts the film up and into contact with a top feed roller 12. The combined forces of the force of gravity, plus the clockwise motion of top roller 12 and the counter-clockwise motion of catch-roller 9, again referenced to FIG. 2, accordingly force film between the two rollers and into the transport system T of the processor. As shown in FIG. 3, transport system T includes pairs of rollers, such as roller pairs 17 and 19. The smooth transition of film from the inclined-plane film guide rack 7 into the transport mechanism is a direct function of the angle of the inclined-plane film guide rack 7 and the positions of catch-roller 9 and top feed roller 12 in relation to the inclined-plane film guide rack 7. The rollers 9 and 12 may be driven by any suitable mechanism, not shown, to accomplish their intended purpose. It will be noted that in the preferred configuration for dental films, as shown, catch-roller 9 and top-feed roller 12 preferrably are positioned slightly higher than all other comparable transport rollers of roller pairs 17 and in a developer transport rack 20, in order to provide for smooth transition of the film's orientation to a horizontal plane. The height difference in the embodiment illustrated is approximately one-eighth inch.

While the top-drop film feed system of the invention has been described in detail with references to the specific figures, it is to be understood that the foregoing description is offered merely by way of example and that the invention is to be limited in scope only by the appended claims.

Having thus described the invention, what is claimed and desired to be secured by Letters Patent is:

1. A film processing apparatus, comprising:
(a) a housing defining a chamber area;
(b) a film transporting system located within said chamber area of the housing;
(c) a top cover for said housing, said top cover having a slot located in it to allow films to be dropped directly into the chamber beneath said housing;
(d) a removable inclined-plane film guide rack located below the slot; and
(e) means, positioned downstream from said inclined-plane film guide rack, for engaging an edge of the film within said housing, said engaging means directing the film from said film guide to said film transporting system of said processor.

2. The film processing apparatus of claim 1 further including sideplates, said inclined-plane film guide rack being removably supported by said sideplates.

3. The film processing apparatus of claim 2 wherein said sideplates define slots, said inclined-plane film guide rack being slidably, removably received in said sideplate slots.

4. In a film processor apparatus having a housing defining a chamber, a top cover, and means for transporting film within the chamber, the improvement comprising film feed means, said film feed means including a portion of said top cover, said top cover portion having a slot therethrough communicating with said chamber, a removable inclined-plane film guide rack located below the slot and extending between said slot and a film drive mechanism, said film drive mechanism including means for engaging an edge of said film for engaging such film and directing said film toward the film transporting means of said processor.

5. The improvement of claim 4 wherein said inclined-plane film guide rack has a plurality of ribs formed in it for supporting the films.

6. The improvement of claim 4 wherein said film guide means further includes first and second rollers, said first and second rollers directing the film to be processed in a horizontal direction, said rollers defining an initial transport path for said film above the transport path of said film for film development.

7. The improvement of claim 6 wherein said first roller is an upper roller and said second roller is lower with respect to said first roller, said inclined-plane film guide rack meeting said second roller at an angle sufficient to allow the force of gravity to move the film down said inclined-plane.

* * * * *